United States Patent [19]

Elliott et al.

[11] 4,385,410

[45] May 31, 1983

[54] ARTICULATED ADJUSTABLE BED HAVING A SINGLE MOTOR DRIVE

[75] Inventors: Franklin E. Elliott, Torrance; Jaime Z. Estrada, Anaheim, both of Calif.

[73] Assignee: Maxwell Products, Inc., Cerritos, Calif.

[21] Appl. No.: 232,658

[22] Filed: Feb. 9, 1981

[51] Int. Cl.[3] ..... A61G 7/00

[52] U.S. Cl. ..... 5/67

[58] Field of Search ..... 5/66–69

[56] References Cited

U.S. PATENT DOCUMENTS

| | | | |
|---|---|---|---|
| 1,658,777 | 2/1928 | Nixon | 5/69 |
| 2,337,284 | 12/1943 | Urie | 5/69 |
| 3,003,160 | 10/1961 | Goodman | 5/69 |
| 3,216,026 | 11/1965 | Mann | 5/66 |
| 3,278,952 | 10/1966 | Holm | 5/66 |
| 3,398,411 | 8/1968 | Douglass | 5/67 |
| 3,644,946 | 2/1972 | Swatt | 5/68 |
| 4,095,296 | 6/1978 | Ferro | 5/69 |

*Primary Examiner*—Francis K. Zugel
*Assistant Examiner*—Michael F. Trettel
*Attorney, Agent, or Firm*—Poms, Smith, Lande & Rose

[57] ABSTRACT

An adjustable bed is shown having an adjustable frame which supports an articulated mattress. The frame mounts a single motor which lifts a first adjustable section thereof through a threaded drive shaft. A push linkage connects from the first adjustable section of the frame back to the frame itself where a conversion plate connects the push linkage to a pull linkage. The pull linkage connects to a second adjustable section of the frame. The single motor thus raises the first adjustable section and, through the linkage, the second adjustable section.

11 Claims, 3 Drawing Figures

ARTICULATED ADJUSTABLE BED HAVING A SINGLE MOTOR DRIVE

BACKGROUND OF THE INVENTION

The concept of an adjustable bed has been known for some time. Early adjustable beds utilized several motors to adjust a bed frame upon which an articulated mattress rested. A typical articulated mattress might be divided into three, four or more sections each mounted upon an adjustable frame section and each driven by an electric motor. Examples of adjustable beds utilizing at least two motors may be found in the following patents: U.S. Pat. No. 2,500,742 by A. J. Taylor; U.S. Pat. No. 2,582,565 by E. V. Schnippel, et al.; U.S. Pat. No. 3,262,133 by S. W. Beitzel; and U.S. Pat. No. 3,644,946 by L. W. Swatt.

Early adjustable beds were manufactured and sold to hospitals and convalescent homes where individuals could be expected to be confined to a bed for an extended period of time. However, with an increasingly affluent society, the market for adjustable beds has been expanding to home usage. During this same time period, the economy has experienced a general inflation. Thus, it is desired to provide an adjustable bed with as few components as possible for economy while retaining as many comfort features as possible.

One component which could be eliminated is the use of a second motor. An example of a single motor adjustable bed wherein the motor is a hydraulic pump which uses two hydraulic cylinders may be found in U.S. Pat. No. 2,520,849 by G. D. McVicker. Another adjustable bed arrangement in which a single motor drives two adjustable sections through a transmission is found in U.S. Pat. No. 3,191,196 by L. E. Holm or U.S. Pat. No. 3,278,952 also by L. E. Holm. A hospital bed utilizing a single motor and three clutches to obtain adjustment of an articulated mattress is shown in U.S. Pat. No. 3,465,373 by H. A. Wilson.

While the foregoing examples represent various approaches for powering an adjustable bed, each of the adjustable beds shown in the examples cited and known in the prior art require complicated drive mechanisms when but a single motor is utilized.

SUMMARY OF THE INVENTION

Accordingly, it is an object of the present invention to provide an adjustable bed which may be manufactured with a rugged and reliable and economical design utilizing fewer components including one motor.

A further object of the present invention is to provide an adjustable bed which may be manufactured with a modular configuration that can be assembled and disassembled for easy shipping, storage and reassembly.

A still further object of the present invention is to provide a linkage mechanism which may be retrofit into existing adjustable beds and which is rugged, reliable and economical.

In accomplishing these and other objects there is provided an adjustable articulated mattress including head, seat, thigh and lower leg sections which rests upon a frame that includes a power drive module that, in turn, nests within a bed frame. The power module comprises a pair of central support sections joined by a lateral support member which supports, at each end, a first and second adjustable section. A single drive motor is mounted upon the lateral support member for driving the first adjustable section through a threaded drive shaft.

Mounted from the first adjustable section back to the lateral support member and then to the second adjustable section of the power drive module is a linkage arrangement which is pushed by the first adjustable section and which pulls the second adjustable section into the desired position. In the preferred embodiment, shown herein as an example, the second adjustable section of the module is provided with a third adjustable section which hinges from the outer end thereof to adjustably support the lower leg portion of the articulated mattress.

DESCRIPTION OF THE DRAWINGS

For a better understanding of the invention summarized above and of the objects and advantages thereof, the reader's attention is directed to the following specification and accompanying drawings, wherein.

DESCRIPTION OF THE PREFERRED EMBODIMENTS

Figure 1:
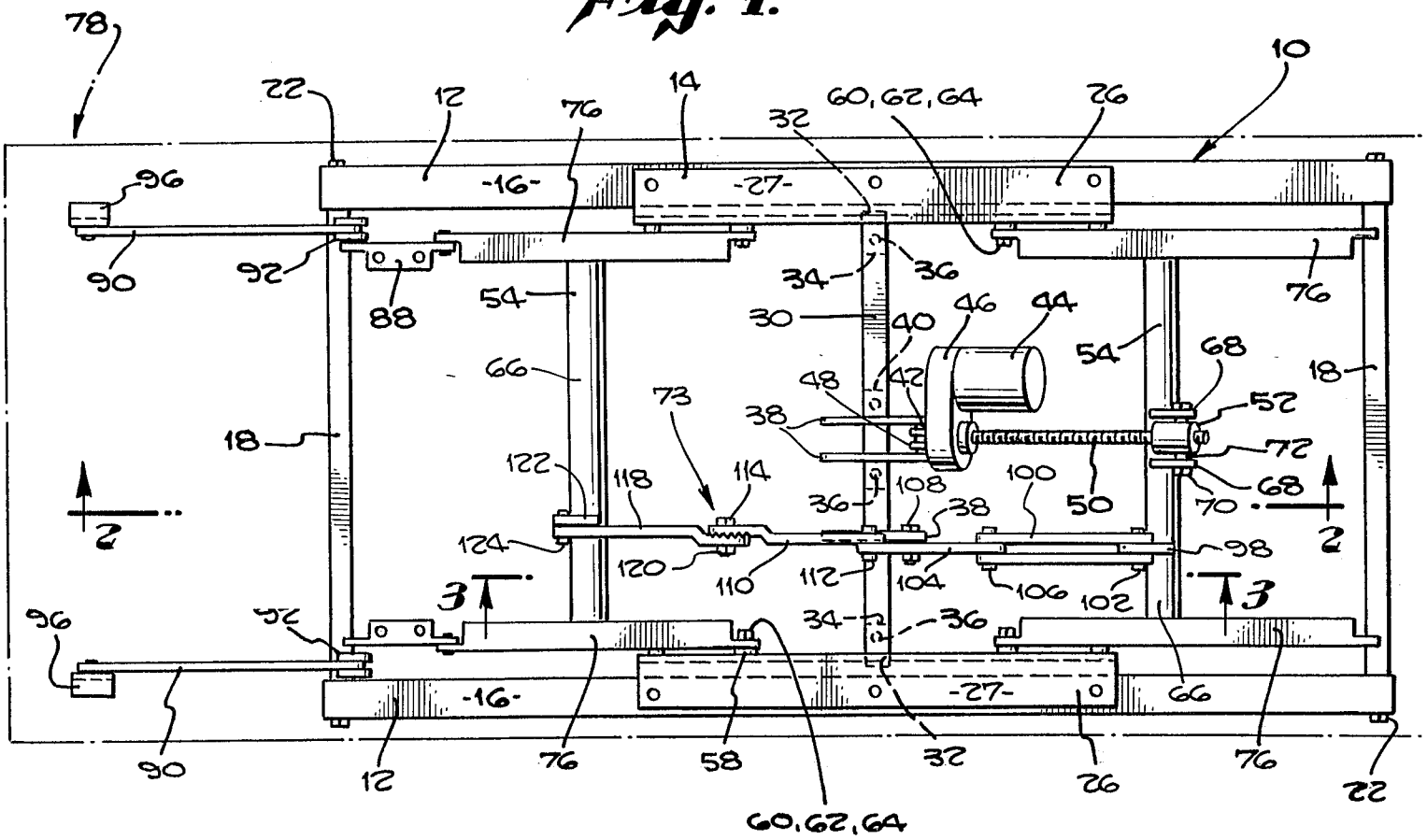
FIG. 1 is a top plane view of a frame including a power drive module nested within a bed frame which mounts the module showing a single motor drive of the present invention mounted within the module.

Referring now to the drawings, FIG. 1 shows an adjustable articulated bed including a frame 10 formed from a bed frame 12 and a power module 14 nested within the frame. The bed frame 12 consists of two longitudinal supports 16 joined by two cross supports 18. The opposite ends of the longitudinal supports 16 are bent at right angles to form vertical, frame support legs 20, FIG. 2. The lower portion of the vertical legs 20 may be provided with sockets or other suitable means for mounting casters, not shown, which assists in moving the bed from place to place. Each cross support 18 is attached to the longitudinal supports 16 by suitable nuts and bolts, 22 and 24.

The power drive module 14 includes a pair of central support sections 26 which are L-shaped in cross section each with the shorter leg 27 thereof extending outwardly therefrom to land upon the longitudinal support 16 of the frame 12. A tubular lateral support member 30 having a square cross section passes between the central support sections 26 for securing these sections of the power module 14 in a spaced, parallel relationship. The square cross section of the lateral support member 30 is inserted into a square aperture 32 found within each support member 26. In stamping the support members 26, the square aperture 32 is formed by a U-shaped stamp which bends the material removed from the square aperture at right angles to the surface of the support members to form tabs 34. The tabs 34, extend under the square cross section of lateral member 30 to support that member and align the central support sections 26 with that member. An aperture may be tapped in the support member 30 to receive a screw 36 for fastening each central support section 26 to the lateral member.

Figure 2:
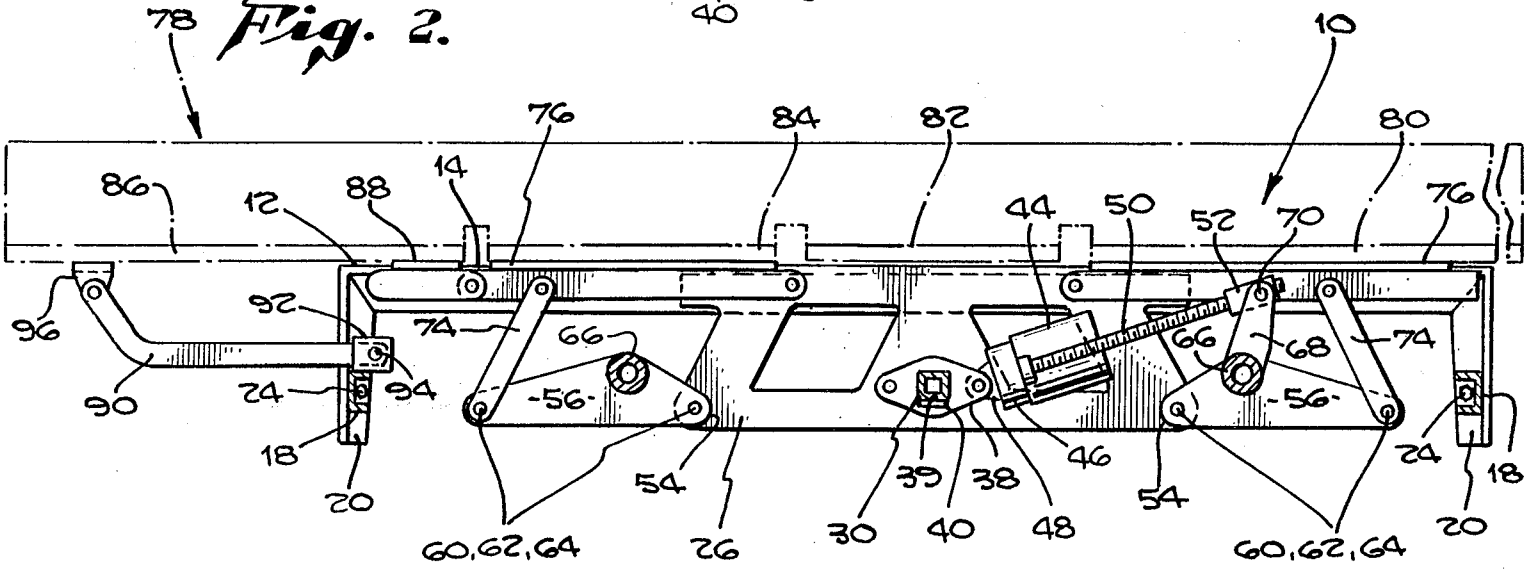
FIG. 2 is a cross-sectional view of the power drive module which mounts the single motor drive linkage of the present invention taken along line 2—2 of FIG. 1.

Mounted midway between the central support sections 26 on support member 30 are a pair of motor connecting plates 38 which have been stamped to produce a square aperture 39, FIG. 2, whose material has been bent at a right angle to produce a tab 40 similar to tab 34. Again, the lateral support member 30 may be tapped to receive mounting screws 36 which secure the motor connectors to the support member 30. The motor connectors 38 are stamped in the shape of a rhombus having apertures at one end through which a pin 42 may be inserted to pivotally mount a drive motor 44. The single drive motor 44 is provided with a gear train 46 having tabs 48 extending from its lower surface through which the pin 42 passes to provide the pivotal mounting. The gear train 46 drives a threaded shaft 50 which passes through a threaded, low friction bushing 52 which may be constructed from a moldable, low friction material, such as nylon.

Mounted to the lower outer corners of each of the central support sections 26 is one leg of an H-shaped torque arm 54, FIG. 2. Each torque arm 54 is constructed from two triangularly shaped plates 56 whose inner ends pivotally connect to the central support sections 26. The pivotal connections are accomplished by stamping a boss 58 into the central support section 26 to provide a raised anular surface against which the plate 56 may ride. The boss 58 is drilled to provide an aperture into which is inserted a shouldered stud 60 which is retained therein by welding. The plate 56 is drilled to provide a larger aperture which receives a pair of shouldered, low friction bushings 62 through which the stud 60 is inserted so that the shoulders of the bushings assure the separation of the plate 56 from the boss 58. A self-locking flange nut 64 retains the plate 56 upon the stud. Between each plate 56 is welded a cross member 66 which completes the H-shaped torque arm subassembly 54.

The right-hand, H-shaped torque arm subassembly 54, in combination with pivot arm 74 and horizontal support members 76, to be described herein below, form a first adjustable section of the power drive module 14 that raises and lowers one section of the articulated mattress.

Extending perpendicularly from the center of the cross member 66 of H-shaped torque arm 56 are a pair of bushing mounting tabs 68 which may be welded to the cross member 66 and which are provided with threaded apertures for receiving shouldered bolts 70 each having a reduced shouldered portion 72 that slidably fit into suitable apertures within the side wall of the bushing 52 to pivotally retain the bushing 52 between tabs 68. The bushing 52 and tabs 68 form the first link in a single motor drive linkage 73, FIG. 3.

Connected to the outer end of the triangular plates 56 which form the H-shaped torque arms 54 are a pair of upwardly extending pivot arms 74 which are pivotally attached to the plate 56 by use of the stud 60, busining 62, and flange nut 64. Similarly, a pair of horizontal support member 76 are pivotally mounted about bosses 58 located in the upper, outer corners of the central support sections 26 by the use of the stud 60, bushing 62, and flange nut 64. In the positions shown, the horizontal support members 76 extend parallel with the central support section 26. Pivotally connected to the horizontal support members 76 are the pivot arms 74 which are attached by the stud, busing, and jam nut 60, 62, and 64, respectively.

It will be understood from the foregoing description that the structural elements attached to the right-hand end of the central support sections 26 form a parallelogram which may be raised when motor 44 is energized for rotating the threaded shaft 50. Rotation of the threaded shaft 50 causes the bushing 52 to move along the longitudinal axis of the shaft 50 for rotating the H-shaped torque arm 54 about the pivot point located at the lower, outer ends of the central support sections 26. This causes the first adjustable section of the power module formed by the members 56, 74, and 76 to rotate in an upward or downward direction with the members 56 and 76 remaining generally parallel to one another; while the member 74 remains generally parallel to a line drawn between the pivot points located in the upper and lower corners of the central supported sections 26.

The structural parallelogram thus described is also found at the left-hand end of the power drive module 14 which forms a second adjustable section of the power module 14 that may be moved up or down by a suitable drive mechanisms such as linkage 73.

As seen in FIG. 2, an articulated mattress 78, formed from a plurality of sections rests upon the drive module 14. In the embodiment shown, the mattress is divided into four sections including a back section 80, seat section 82, thigh 84 and lower leg section 86. The seat section 82 mounts upon the center support sections 26 of module 14 and is secured thereto by screws, not shown. Similarly, the back section 80 mounts upon the right-hand horizontal support members 76 and is secured thereto by screws to form a back raising section; while the thigh section 74 mounts upon the left-hand horizontal support members 76 that form the leg rising section of the power drive module 14.

The embodiment for adjusting the lower leg mattress section 86, FIG. 2, includes a hinge 88 which is pivotally attached to the outer end of the left-hand horizontal support member 76. This hinge is secured to the lower leg section 86 of the mattress 78, by screws, not shown. The far end of the lower leg section 86 is supported by a pair of J-shaped pivotal linkages 90 that are removably mounted upon the cross support 18 of the frame 12 by a U-shaped hinge element 92 which receives the pivotal linkages 90 between the upwardly extending legs and retains them by use of hinge pins 94. An L-shaped pivot hinge 96 is mounted at the end of the short leg of each J-shaped linkage to attach the outside edge of the mattress section 86.

The single motor drive linkage 73 transfers the mechanical motion of the first right-hand adjustable section to the second left-hand adjustable section of the power module 14 through a unique push-pull linkage arrangement which may be adjusted to assure that the articulated mattress 78 lies in a coplanar position.

Figure 3:
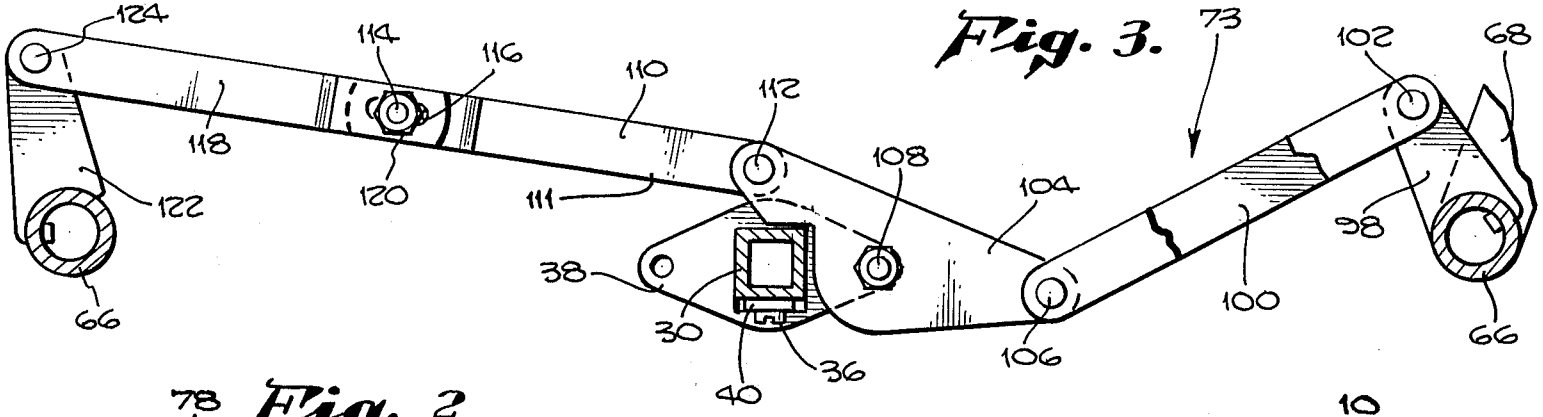
FIG. 3 is a cross-sectional view of the single drive motor linkage taken along line 3—3 of FIG. 1.

Welded to the right-hand cross member 66 is a tab 98, FIG. 3, which extends at right angles to member 66 and which is substantially identical to the tab 68. The outermost end of tab 98 is pivotally connected to a pair of push linkage arms 100 by a pin 102. Pin 102 may be formed in a manner similar to the stud, bushing, and flange nut arrangement 60, 62, and 64, described above or may be attached by other suitable means, such as cotter pins. The first push linkage formed by push arms 100 pivotally connects to a pivoted converter 104 through the use of a second pin 106. The converter plate 104 is generally triangular with a notched section which rests upon lateral support member 30 to form a stop for the single motor drive linkage 73. The converter 104 is connected to member 30 by a connector 38, having a tab 40 which is secured to the member 30 by a screw 36. Converter 104 pivotally attaches to the connector 38 by a post 108 which mounts low friction bushings having flanges thereon that separate the converter 104 from the connector 38. On the opposite end of the converter 104 from the pivotal connection of the push linkage 100 is connected a pull linkage 110. In the preferred embodiment, there is but one pull linkage 110 used since there is no tendency to buckle when the linkage is placed in tension.

However, the linkage 110 is constructed from two pieces having their mating ends offset and serrated to permit an adjustable connection. The first link 111 of the pull linkage 110 pivotally connects to the converter 104 by a pin 112; while its opposite, serrated end is provided with a clearance hole through which a bolt 114 is inserted. Bolt 114 passes through a slot 116 in the serrated end of a second pull link 118 of linkage 110. By loosening a nut 120 upon the bolt 114, it is possible to adjust the length of the pull linkage 110. The single motor drive linkage 73 is completed by a tab 122 welded to the left-hand cross member 66 which pivotally secures the linkage 110 thereto by a pin 124.

From the foregoing, it will be noted that the adjustable articulated bed may be driven by a single motor 44 through the drive linkage 73. As the motor 44 causes the shaft 50 to turn, the bushing 52 travels along the longitudinal axis of shaft 50 for raising or lowering the structural parallelogram formed on the right-hand side of the power module 14 by elements 56, 74, and 76. The rotational motion of the cross member 66 about the pivot point in the lower right-hand corner of support sections 26 causes tab 98 to push the linkages 100 against the converter 104. Converter 104 then rotates about pin 108 and pulls the linkage 110 which, in turn, pulls the tab 122 and rotates the left-hand cross member 66 for raising the thigh section 84 of the mattress 78. As the thigh section of the mattress raises under the urging of the parallelogram formed by the left-hand element 56, 74, and 76, the lower leg section 86 of the mattress follows but remains generally parallel to the original plane of the mattress.

Thus, it will be seen that the single motor 44 is capable of adjusting the four sectioned articulated mattress 78. By use of the flat on convertor 104 which engages the lateral support 30, it is possible to reference the articulated mattress to a horizontal position. Using the flat as a reference point, the linkage 110 may be adjusted to assure that the thigh and lower leg portions are horizontal when the back portion is in that position.

The single motor drive of the present invention may be utilized in existing articulated beds or in beds of a new design. The plate 38 is arranged with a square apperture for retrofit upon square cross sectioned members 30. Similarly, pivot pins 102, 106, 108, 112, and 124 may be easily removed and replaced by the use of threads or cotter pins for ease of retrofitting or module construction. While the present invention has been described within a particular embodiment of an articulated bed, it will be understood that other embodiments are also possible. Accordingly, the present invention should be limited only by the appended claims.

I claim:

1. In an adjustable bed having an adjustable frame that supports an articulated mattress including at least first, second and third sections adjusted by adjustment of said frame, the improvement comprising:

support sections forming the sides of said frame;

at least one lateral support member joining said support sections;

a single motor mounted within said frame upon said lateral support member;

said frame having a first adjustable section to support and adjust said first section of said articulated mattress and a second adjustable section to support and adjust said third section of said mattress, said second section thereof being mounted upon said frame;

said first and second adjustable sections pivotally mounted upon said adjustable frame;

mechanical drive means connecting said single motor to said first adjustable section of said frame for raising and lowering said first section;

linkage means connected from said first adjustable section to said lateral support member and then to said second adjustable section for raising and lowering said second adjustable section, including:

(a) a pivot converter mounted upon said lateral support member;

(b) a first push linkage means attached from said first adjustable section to said pivot converter; and (c) a second pull linkage means attached from said pivot converter to said second adjustable section wherein the raising of said first adjustable section will push said first push linkage against said converter for pulling said second pull linkage against said second adjustable section for raising said second adjustable section.

2. An adjustable bed, as claimed in claim 1, wherein:

said first push linkage means includes a pair of pushing arms pivotally connected from said first adjustable section to said pivot converter; and said second pull linkage means includes a single arm pivotally connecting said pivot converter to said second adjustable section.

3. An adjustable bed, as claimed in claim 2, wherein said second pull linkage means includes two linkage elements joined at each end by serrated end sections to permit the longitudinal adjustment of said linkage to assure that said articulated mattress lies flat upon said frame.

4. An adjustable bed, as claimed in claim 1, wherein said single motor and said pivot converter each pivotally mount upon connector means attached to said lateral support member.

5. An adjustable bed, as claimed in claim 1, wherein said first section of said articulated mattress is a back section, said second section thereof is a seat section, and said third section thereof is a leg section having a thigh and lower leg section and additionally comprising:

a third adjustable section of said frame pivotally connected to said second adjustable section of said frame wherein adjustment of said second section by said linkage means also adjusts said third adjustable section.

6. An adjustable bed, as claimed in claim 1, wherein said adjustable frame includes:

a bed frame;

an adjustable power drive module nested within said bed frame;

said support sections form the sides of said power drive module; and said first and second adjustable sections pivotally mounted upon the ends of said support section.

7. An adjustable bed, as claimed in claim 1, wherein said mechanical drive means connecting said sngle motor to said first adjustable section includes:

a threaded shaft driven by said single motor;

a threaded bushing mounted upon said shaft; and pivot means mounting said threaded bushing to said first adjustable section.

8. An adjustable bed, as claimed in claim 7, wherein said threaded bushing is formed from a moldable, low friction material to provide smooth, low friction operation of said threaded shaft and said pivot means.

9. In an adjustable bed driven by a single motor having an adjustable frame that supports an articulated mattress including at least first, second and third sections adjusted by adjustment of said frame, the improvement comprising:

side support sections forming the sides of said adjustable frame;

at least one lateral support member joining said side support sections;

a single motor mounted upon said lateral support member;

first and second adjustable sections pivotally mounted upon opposite ends of said side support sections to respectively support and adjust said first and third sections of said articulated mattress, said second mattress section mounted upon said frame;

drive means connecting said single motor to said adjustable section of said frame for raising and lowering said first section;

pivot means mounted upon said lateral support member;

first linkage means mounted between said first adjustable section and said pivot means; and second linkage means mounted between said pivot means and said second adjustable section wherein the raising of said first adjustable section will push said first linkage against said pivot means for pulling said second linkage against said second adjustable section to raise said second adjustable section.

10. In an adjustable bed, as claimed in claim 9, wherein said drive means connecting said motor to said first adjustable means is in tension, said first linkage means is in compression, and said second linkage means is in tension during adjustment of said frame.

11. In an adjustable bed, as claimed in claim 9, wherein said first linkage means include a pair of parallelly connected links for increased strength and said second linkage includes a pair of serially connected links for adjustability.

* * * * *